US010993513B2

(12) United States Patent
Ledermann

(10) Patent No.: US 10,993,513 B2
(45) Date of Patent: May 4, 2021

(54) ADJUSTABLE LOOP FOR A WATCH

(71) Applicant: Eric Ledermann, Tampa, FL (US)

(72) Inventor: Eric Ledermann, Tampa, FL (US)

( * ) Notice: Subject to any disclaimer, the term of this patent is extended or adjusted under 35 U.S.C. 154(b) by 0 days.

(21) Appl. No.: 16/253,863

(22) Filed: Jan. 22, 2019

(65) Prior Publication Data

US 2019/0223563 A1 Jul. 25, 2019

Related U.S. Application Data

(60) Provisional application No. 62/619,960, filed on Jan. 22, 2018.

(51) Int. Cl.
*A44C 5/20* (2006.01)

(52) U.S. Cl.
CPC ..... *A44C 5/2071* (2013.01)

(58) Field of Classification Search
CPC ..... A44C 5/2071; A44C 5/2014; A44C 5/185; A44C 5/2019; A44C 5/18; Y10T 24/4044; A44D 2211/02; A44B 11/24
See application file for complete search history.

(56) References Cited

U.S. PATENT DOCUMENTS 35,049 A * 4/1862 Topham ..... A44B 11/06 24/168
291,150 A * 1/1884 Chandler ..... A44B 11/06 24/168
1,100,389 A * 6/1914 Miller ..... A41F 9/002 24/182
1,414,048 A * 4/1922 Schlutz ..... A44B 99/00 24/499
4,855,974 A * 8/1989 Steinmann ..... A44B 11/18 368/282
5,189,763 A * 3/1993 Voumard ..... A44B 11/22 24/163 R
6,830,166 B1 * 12/2004 Laats ..... A44C 5/0053 224/164
2010/0018008 A1 * 1/2010 Ahn ..... A44B 11/16 24/303

* cited by examiner

*Primary Examiner* — Robert Sandy
*Assistant Examiner* — Rowland Do
(74) *Attorney, Agent, or Firm* — Wei & Sleman LLP

(57) ABSTRACT

A watch includes a case having a dial, a first strap attached to a first end of the case, the first strap having a plurality of adjustment holes, a second strap attached to a second end of the case, the second strap having a buckle for mating with at least one of the adjustment holes, an adjustable loop disposed over the second strap and having a base portion and a top plate coupled to the base portion and defining a gap therebetween, the adjustable loop being transitionable between a first condition where the base portion and the top plate are relatively far from one another and the gap has a first length, and a second condition where the base portion and the top plate are relatively close to one another and the gap has a second length, the second length being less than the first length.

17 Claims, 5 Drawing Sheets

ADJUSTABLE LOOP FOR A WATCH

CROSS-REFERENCE TO RELATED APPLICATIONS

This application claims priority to U.S. Provisional Application Ser. No. 62/619,960, filed Jan. 22, 2018, entitled "ADJUSTABLE LOOP FOR A WATCH," the contents of which are fully incorporated as if fully set forth herein.

FIELD OF THE DISCLOSURE

The present disclosure relates to watches. More particularly the present disclosure relates to adjustable loops for watches.

BACKGROUND OF THE DISCLOSURE

A wrist watch typically includes a case disposed between two straps or bands that hold the watch on a user's wrist. One of the straps may include a buckle, while the other strap includes a number of adjustment holes. A user may choose one of the adjustment holes based on the size of his/her wrist, and couple the buckle thereto. Thus, a single set of straps is capable of accommodating a number of users having different wrist sizes.

A free loop may be disposed adjacent the buckle to hold an extra portion of the strap. This free loop may be movable along the length of the strap.

SUMMARY OF THE DISCLOSURE

In some embodiments, a watch may include a case having a dial, a first strap attached to a first end of the case, the first strap having a plurality of adjustment holes, a second strap attached to a second end of the case, the second strap having a buckle for mating with at least one of the adjustment holes, an adjustable loop disposed over the second strap and having a base portion and a top plate coupled to the base portion and defining a gap therebetween, the adjustable loop being transitionable between a first condition where the base portion and the top plate are relatively far from one another and the gap has a first length, and a second condition where the base portion and the top plate are relatively close to one another and the gap has a second length, the second length being less than the first length.

BRIEF DESCRIPTION OF THE DISCLOSURE

Various embodiments of the presently disclosed connectors are disclosed herein with reference to the drawings, wherein.

Figure 3A:
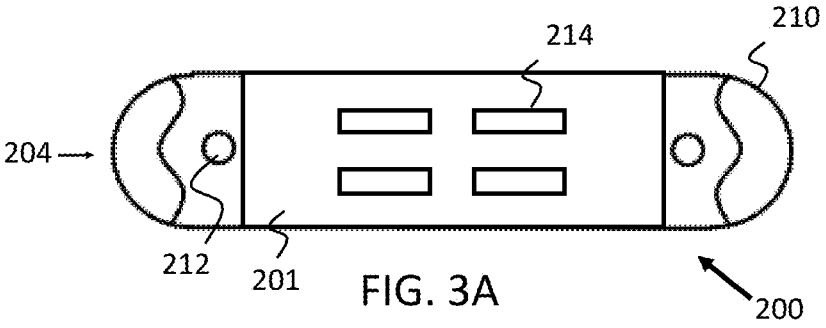
Figure 3B:
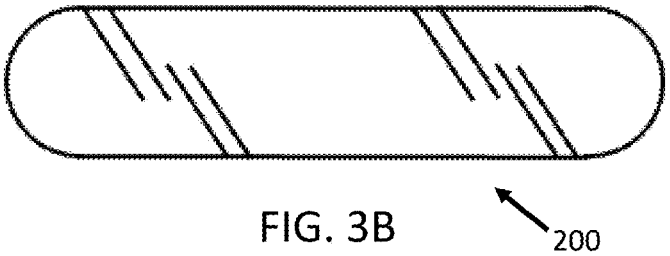
Figure 3C:
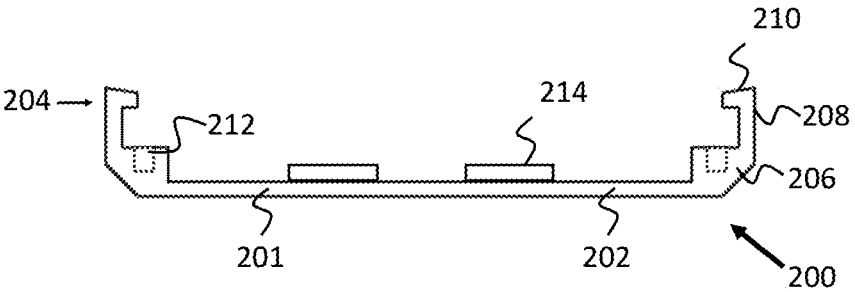
Figure 4A:
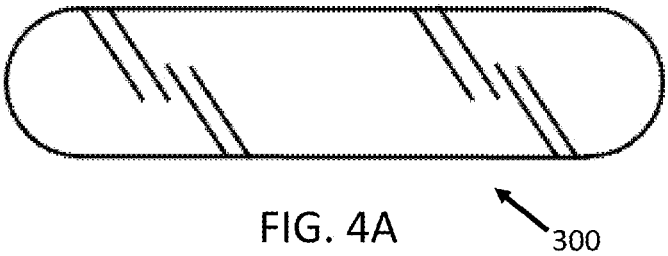
Figure 4B:
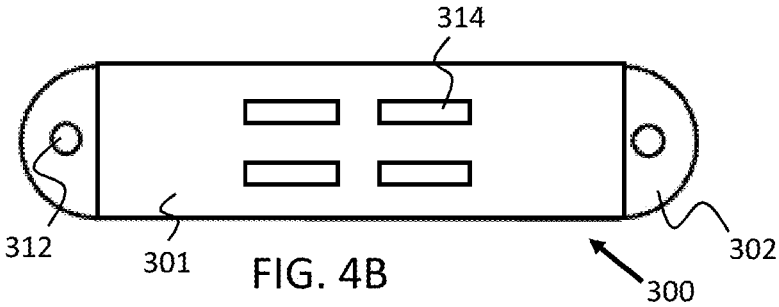
Figure 4C:
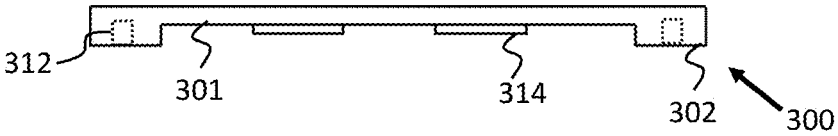
Figure 5:
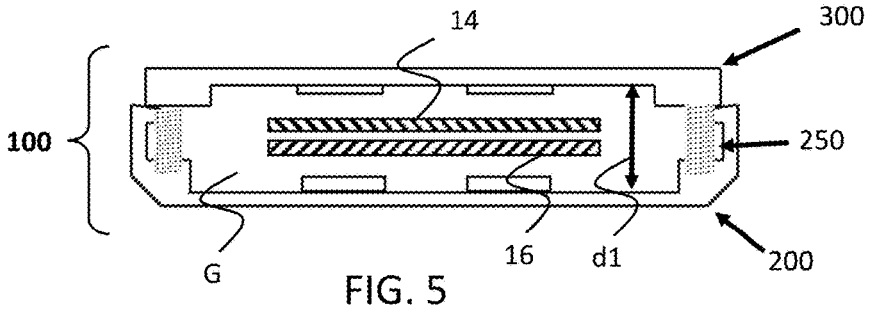
Figure 6:
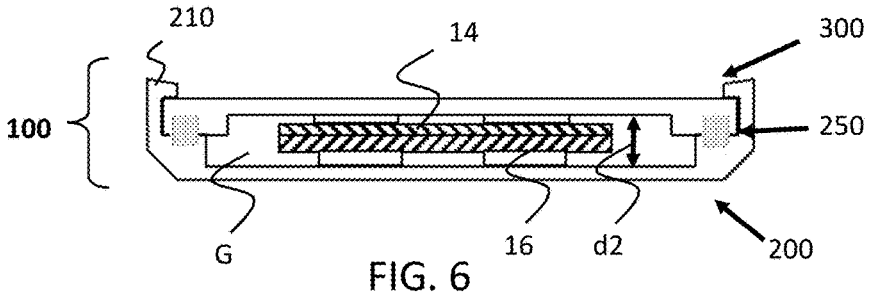

FIGS. 3A-C are top, bottom and side views of a base portion of an adjustable loop;

FIGS. 4A-C are top, bottom and side views of a top plate of an adjustable loop;

FIG. 5 is a schematic cross-section of an adjustable loop in a first condition with portions of straps disposed therein; and FIG. 6 is a schematic cross-section of an adjustable loop in a second condition with portions of straps disposed therein.

Various embodiments of the present invention will now be described with reference to the appended drawings. It is to be appreciated that these drawings depict only some embodiments of the invention and are therefore not to be considered limiting of its scope.

DETAILED DESCRIPTION

Despite the various improvements that have been made to watches, conventional devices suffer from some shortcomings.

There therefore is a need for further improvements to the devices, systems, and methods of manufacturing watches. Among other advantages, the present disclosure may address one or more of these needs.

As used herein, the term "proximal," when used in connection with a component of a watch, refers to the end of the component closest to the case, whereas the term "distal," when used in connection with a component of a watch, refers to the end of the component farthest from the case.

Figure 1A:
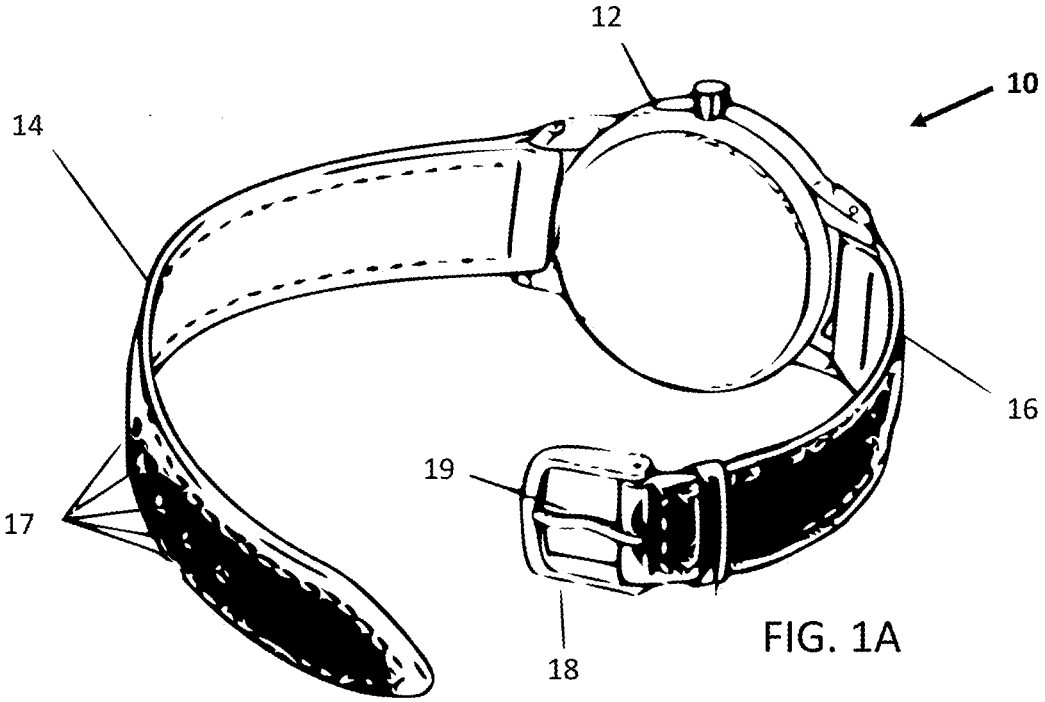
FIGS. 1A and 1B are a perspective illustration of a wrist watch, and an illustration of a side view of the wrist watch.

FIG. 1A illustrates one embodiment of a wrist watch 10 to be used with one embodiment of the present disclosure. Wrist watch 10 generally includes a case 12. Case 12 may be a metallic or plastic housing that encloses the inner mechanisms of the watch as is generally known. For example, case 12 may include a number of gears, a power source (e.g., battery), a dial having a number of hands, and other components, and may include a crystal covering to allow viewing and protection of the dial. Case 12 may extend between a first end and a second end, and may be coupled adjacent the first end to a first strap 14, and coupled adjacent the second end to a second strap 16.

First strap 14 may include a number of adjustment holes 17 longitudinally aligned with the center of the first strap 14 and spaced apart from one another. Second strap 16 may include a rectangular buckle 18 having a tang or prong 19. When first strap 14 and second strap 16 are brought together, buckle 18, and specifically prong 19 of the buckle, may mate with one of the adjustment holes 17 of the first strap to secure the watch on the wrist of a user.

Figure 1B:
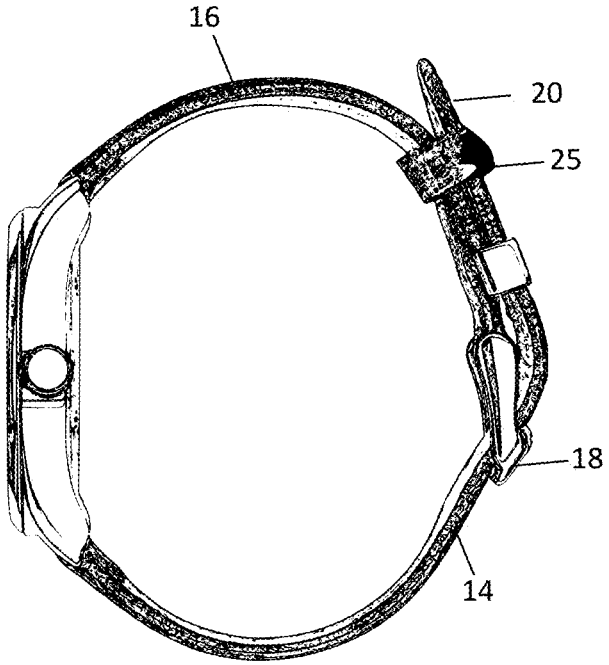

In some situations, when the first strap 14 and the second strap 16 are coupled together via buckle 18, an excess portion 20 of the first strap 14 extends beyond buckle 18 as shown in FIG. 1B. This excess portion 20 naturally projects away from second strap 16 due to the curvature of the straps when worn on a wrist. A free loop 25 may be used to hold down excess portion 20, but such a free loop does not always stay in place and may slide over the excess portion 20, releasing the excess portion.

Thus, an adjustable loop may be used instead of (or in some cases in addition to) one or more free loops to secure this excess portion 20 of first strap 14 as will be explained in greater detail with reference to FIGS. 2-6.

Figure 2:
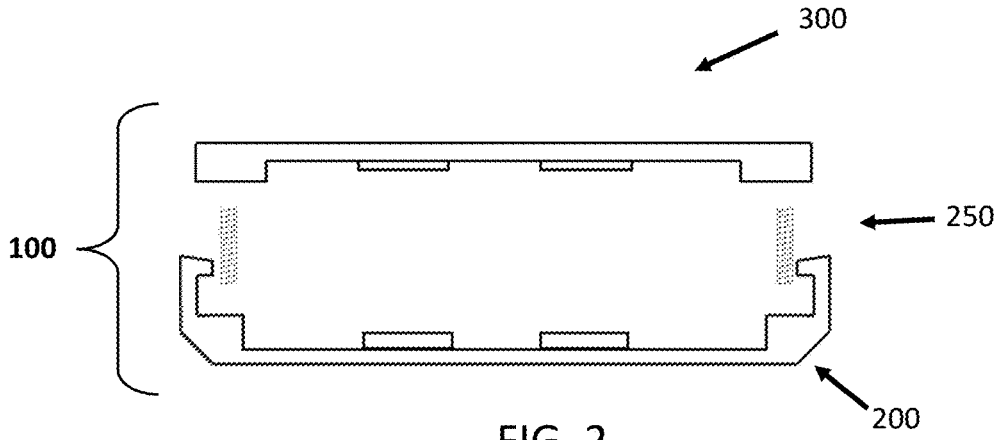
FIG. 2 is an exploded side view of an adjustable loop having a base portion, a top plate, and a pair of springs.

FIG. 2 is an exploded side view of adjustable loop 100. Adjustable loop 100 generally includes a base portion 200, a top plate 300, and a pair of springs 250 disposed between the base portion and the top plate. Adjustable loop 100 may generally be capable of transitioning or actuating between a first, open condition, and a second, closed condition. To better understand the mechanism of adjustable loop 100, the details of each of its components will be described separately.

FIGS. 3A-C are top, bottom and side views of base portion 200. As shown, base portion 200 include a generally U-shaped body 201. Body 201 may be made of a plastic, a resin, a metal, a wood, carbon fiber or any other suitable material or combination of materials. Body 201 may include a generally flat platform 202 and a pair of orthogonal sidewalls 204 projecting from platform 202. Each sidewall 204 may include a first step 206, a second step 208 and a perpendicular ridge 210, perpendicular ridge 210 and platform 202 being substantially parallel with one another. First step 206 may define a spring aperture 212 for receiving a portion of spring 250. Optionally, platform 202 may include one or more ribs 214 disposed longitudinally thereon to increase friction with a strap.

FIGS. 4A-C are top, bottom and side views of a top plate 300 of adjustable loop 100. Top plate 300 includes a generally flat body 301 having a pair of projections 302 that project from the flat body. Body 301 may be made of a plastic, a resin, a metal, leather, rubber, wood, carbon fiber or any other suitable material or combination of materials. In at least some examples, body 201 of the base portion and body 301 of the top plate are formed of the same material. Alternatively, body 201 of the base portion and body 301 of the top plate are formed of different materials. As shown, top plate 300 is slightly shorter than base portion 200 so that it may be received therein below the perpendicular ridges 210. Additionally, the distance between the two projections 302 may be selected to be slightly longer than the width of at least one of the straps. Each projection 302 of top plate 300 includes a complementary spring aperture 312 for receiving the second end of spring 250 so that the spring extends between the two structures of the top plate and the base portion. In at least some examples, spring apertures 212,312 are the same shape and size. Additionally, top plate 300 may include one or more ribs 314, similar to ribs 214 to increase friction with a strap. In the embodiment shown, top plate 300 includes four ribs 314 spaced from one another in a rectangular configuration.

FIG. 5 is a side view of an adjustable loop 100 in a first, open condition with a portion of straps 14,16 disposed therein. As used herein the term "open condition" generally refers to a state of the adjustable loop 100 where the top plate and the base portion are relatively far from one another. As shown in FIG. 5, a gap "G" is formed between base portion 200 and top plate 300 to receive the strap 14,16. In this open condition, springs 250 are relatively relaxed (or, are not fully compressed) so that the distance d1 between the bottom surface of the top plate 300 and the upper surface of the base portion 200 (i.e., the height of the gap "G") may be between about 3.0 mm and about 9.0 mm.

Conversely, FIG. 6 is a side view of an adjustable loop 100 in a second, closed condition with a portion of straps 14,16 disposed therein. As used herein the term "closed condition" generally refers to a state of the adjustable loop 100 where the top plate and the base portion are relatively near one another as compared to the open condition. In the closed condition, spring 250 is disposed between the base portion 200 and the top plate 300 and more compressed than it was in the open condition. Moreover, in the closed condition, top plate has slipped inside the cavity of the base portion and the perpendicular ridges 210 have snapped over the top plate. Thus, perpendicular ridges 210 of base portion 200 are at least partially disposed above top plate 300 to keep the spring compressed and retain the adjustable loop in the closed condition. In this closed condition, the distance d2 between the bottom surface of the top plate 300 and the upper surface of the base portion 200 may be between about 2.0 mm and about 8.0 mm. Thus, the distance d2 between the two members (e.g., the top plate and the base portion) of the adjustable loop in the closed condition is less than the distance d1 between the two members in the open condition. Distances d1 and d2 may be varied based on the thickness of the straps of the watch. The distance d2 between the two members in the closed condition may be chosen such that when the adjustable loop is in the closed condition, the top plate and the base portion apply a force on the straps 14,16 and prevent movement of the straps. Thus, friction forces between the top plate and the base portion and the strap 14,16 are capable of preventing the adjustable loop from translating over the straps. To that end, optional ribs 214,314 may provide additional friction to affix the adjustable loop along a predetermined length of the strap of the watch in the closed position. Thus, in the closed condition, the adjustable loop 100 is locked by the user along a length of the strap and stays in that position until the user decides to take off the watch or adjust it.

To release the adjustable loop 100 and transition it back to the open condition, a user may press the lower portions of the sidewalls 204 of base portion 200, which cause the perpendicular ridges 210 of the base portion to spread apart, and release the top plate from underneath, the springs 250 forcing the top plate 300 away from the base portion. With the top plate and the base portion being disposed in the open condition, the distance between the two structures is increased to distance d1 and the two straps are no longer confined within the adjustable loop.

Thus, a watch can be worn on a wrist and an adjustable loop may be used to retain the excess portion of a strap. Because users may have wrists of different sizes, the excess portion of a strap may vary. A user may simply slide the adjustable loop to the desired position along the strap and lock it so that the excess portion of the strap is retained and the adjustable strap is incapable of travel along the strap. A user may also actuate the adjustable loop to re-adjust the position of the loop and then lock it at the desired location. With the adjustable loop locked in position, discomfort or irritation from movement of the loop along the strap is eliminated, and the excess portion of the strap is secured.

Other mechanisms for the adjustable loop are possible. Additionally, it will be understood that the addition of an adjustable loop may be used in addition to the standard buckle-hole coupling mechanism, or instead of such mechanism and that the embodiments disclosed herein are merely exemplary and non-limiting.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

It will be appreciated that the various dependent claims and the features set forth therein can be combined in different ways than presented in the initial claims. It will also be appreciated that the features described in connection with individual embodiments may be shared with others of the described embodiments.

What is claimed is:

1. A watch comprising:

a case having a dial;

a first strap attached to a first end of the case, the first strap having a plurality of adjustment holes;

a second strap attached to a second end of the case, the second strap having a buckle for mating with at least one of the adjustment holes;

an adjustable loop disposed over the second strap and having a base portion and a top plate coupled to the base portion and defining a gap therebetween, the adjustable loop being transitionable between a first condition where the base portion and the top plate are relatively far from one another and the gap has a first length, and a second condition where the base portion and the top plate are relatively close to one another and the gap has a second length, the second length being less than the first length; and two springs disposed between the base portion and the top plate;

wherein the base portion includes two projecting sidewalls, each of the two projecting sidewalls having a first step for receiving one of the two springs, and a second step, the second step including a perpendicular ridge that extends over at least a portion of the top plate in the second condition of the adjustable loop.

2. The watch of claim 1, wherein the base portion and the top plate include resin.

3. The watch of claim 1, wherein the base portion and the top plate include plastic.

4. The watch of claim 1, wherein, in the second condition, the gap of the adjustable loop is large enough to house at least a portion of the first strap and the second strap, and sufficient friction is present between a portion of the adjustable loop and at least one of the first strap and the second strap so that the adjustable loop is immovable relative to at least one of the first strap and the second strap.

5. The watch of claim 1, further comprising a release mechanism to allow the adjustable loop to transition from the second condition to the first condition when actuated.

6. The watch of claim 1, wherein pressing lower portions of the projecting sidewalls towards one another causes the ridges of the perpendicular sidewalls to spread apart and release the top plate.

7. The watch of claim 1, wherein the buckle is a tang buckle.

8. The watch of claim 1, wherein the first strap and the second strap are made of leather.

9. The watch of claim 1, wherein the first strap and second strap are made of rubber.

10. The watch of claim 1, wherein the first strap and the second strap are made of a same material.

11. An adjustable loop for a watch, the adjustable loop comprising:

a U-shaped base portion including two projecting sidewalls;

a top plate coupled to the base portion and defining a gap therebetween;

a pair of springs disposed between and coupling the top plate and the U-shaped base portion, wherein the top plate is moveable between a first position where the base portion and the top plate are relatively far from one another and the gap has a first length, and a second position where the base portion and the top plate are relatively close to one another and the gap has a second length, the second length being less than the first length, and wherein each of the two projecting sidewalls includes a first step for receiving one of the pair of springs, and a second step, the second step including a perpendicular ridge that extends over at least a portion of the top plate in the second position of the adjustable loop.

12. The adjustable loop of claim 11, wherein the pair of springs are compressed when the top plate is in the second position.

13. The adjustable loop of claim 12, wherein, when the top plate is in the second position, the perpendicular ridges apply a sufficient force to the top plate and maintain the pair of springs in their compressed state.

14. The adjustable loop of claim 11, wherein the gap is sized to receive two straps of a watch, and the adjustable loop is able to travel over the two straps in the first condition but not in the second condition.

15. The adjustable loop of claim 11, wherein the top plate includes at least one longitudinally extending rib on a surface of the top plate that faces the base portion.

16. The adjustable loop of claim 11, wherein the base portion includes at least one longitudinally extending rib on a surface of the base portion that faces the top plate.

17. The adjustable loop of claim 11, wherein pressing lower portions of the projecting sidewalls of the U-shaped base portion towards one another causes the perpendicular ridges of sidewalls to spread apart.

* * * * *